US006278422B1

(12) United States Patent
Ukai et al.

(10) Patent No.: US 6,278,422 B1
(45) Date of Patent: Aug. 21, 2001

(54) METHOD OF DRIVING PLASMA DISPLAY PANEL AND DISPLAY APPARATUS

(75) Inventors: Yoshitaka Ukai, Higashimoro Kata-gun; Hitoshi Hirakawa, Takasago, both of (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/282,190

(22) Filed: Mar. 31, 1999

(30) Foreign Application Priority Data

Sep. 18, 1998 (JP) ..... 10-264509

(51) Int. Cl.[7] ..... G09G 3/28
(52) U.S. Cl. ..... 345/63; 345/60
(58) Field of Search ..... 345/60, 63, 67, 345/68, 147, 148, 77, 89; 315/169.1–4; 348/671

(56) References Cited

U.S. PATENT DOCUMENTS 5,745,086 * 4/1998 Weber ..... 345/63
5,943,032 * 8/1999 Nagaoka ..... 345/63
6,037,917 * 3/2000 Kawakami ..... 345/63
6,072,448 * 6/2000 Kojima et al. ..... 345/63
6,097,358 * 8/2000 Hirakawa et al. ..... 345/63

* cited by examiner

*Primary Examiner*—Richard Hjerpe
*Assistant Examiner*—Alexander Eisen
(74) *Attorney, Agent, or Firm*—Staas & Halsey LLP

(57) ABSTRACT

In a method of driving a plasma display panel to display gradation, a field includes a plurality of subfields, the subfields of each field are separated into a plurality of subfield groups, and each subfield is weighted in brightness in such a manner that the subfields in the subfield group are all equal in weight. An address period and a sustain period are allocated to each subfield. In at least one subfield group, a number of times of sustaining discharge for a subfield to be sustained independently is set different from a number of times of sustaining discharge for at least one other subfield.

9 Claims, 7 Drawing Sheets

| FIELD | | f | | | | | | | |
|---|---|---|---|---|---|---|---|---|---|
| SUBFIELD GROUP | | s f g 1 | | s f g 2 | | s f g 3 | | s f g 4 | |
| SUBFIELD | | s f 1 | s f 2 | s f 3 | a f 4 | s f 5 | s f 6 | s f 7 | s f 8 |
| BRIGHTNESS WEIGHT | | 1 | 1 | 3 | 3 | 9 | 9 | 2 7 | 2 7 |
| NUMBER OF SUSTAINING PULSE PAIRS | ERASE ADDRESSING | 6 | 6+q1 | 18 | 18+q2 | 54 | 54+q3 | 162 | 162+q4 |
| | WRITE ADDRESSING | 6+q1 | 6 | 18+q2 | 18 | 54+q3 | 54 | 162+q4 | 162 |

Fig. 7

| FIELD | | f | | | | | | | |
|---|---|---|---|---|---|---|---|---|---|
| SUBFIELD GROUP | | sfg1 | | sfg2 | | sfg3 | | sfg4 | |
| SUBFIELD | | sf1 | sf2 | sf3 | af4 | sf5 | sf6 | sf7 | sf8 |
| BRIGHTNESS WEIGHT | | 1 | 1 | 3 | 3 | 9 | 9 | 27 | 27 |
| NUMBER OF SUSTAINING PULSE PAIRS | ERASE ADDRESSING | 6 | 6+q1 | 18 | 18+q2 | 54 | 54+q3 | 162 | 162+q4 |
| | WRITE ADDRESSING | 6+q1 | 6 | 18+q2 | 18 | 54+q3 | 54 | 162+q4 | 162 |

METHOD OF DRIVING PLASMA DISPLAY PANEL AND DISPLAY APPARATUS

BACKGROUND OF THE INVENTION

1. Field of the Invention

The present invention relates to a method of driving a plasma display panel (PDP) of AC type and a display apparatus using the method.

With the practical application of the color screen as a motive, PDP has come to be widely used for various applications including the TV picture and the computer monitor. It has also been closely watched as a means for realizing a large screen of high-definition TV. For developing the high definition and large screen of PDP further, it is necessary to reduce power consumption while securing the display quality.

2. Description of the Related Art

The PDP of AC type has such a structure that in order to sustain the on-state utilizing the wall charge, the main electrodes are covered with a dielectric material. In display, only the cells to be turned on (to emit light) are charged by the line-by-line addressing operation, after which all the cells are supplied with the sustain voltage Vs of alternate polarities at the same time. The sustain voltage Vs satisfies equation (1).

$$Vf-V\text{wall}<Vs<Vf \quad (1)$$

where Vf is the discharge start voltage, and Vwall is the wall voltage.

In cells having the wall charge, the wall voltage Vwall is superimposed on the sustain voltage Vs, and therefore the effective voltage (also called the cell voltage) Veff applied to the cells exceeds the discharge start voltage Vf and causes a discharge. In the case where the sustain voltage Vs is applied in a shorter period of time, the apparently continuous on-state is obtained. The brightness of display is dependent on the number of times the discharge occurs per unit time. The halftone, therefore, is reproduced by appropriately setting the number of times the discharge occurs in each field (in each frame for no-interlace system) for each cell according to the gradation level. The color display is a kind of gradation display and the display color is determined by a combination of the brightness of the three primary colors.

In a widely-known method of displaying the gradation with PDP, each field is configured of a plurality of subfields weighted by brightness, and the total number of times the discharge occurs per field is set by a combination of subfields turned on and off (as disclosed in JP-A-04-195188). The "weight of brightness" or "brightness weight" is a numerical value (normally given by an integer with a minimum value of unity) for determining which subfield(s) is selected for turning on according to the gradation of the input image. Generally, what is called the "binary weighting" is employed, in which the weight of each subfield is expressed as $2^n$ (n=0, 1, 2, 3 . . . ). Assuming that there are eight subfields, for example, 256 gradations from 0 to 255 can be displayed.

The binary weighting has no redundancy and is suitable for multiple gradations. For securing a uniform gradation width (the brightness difference for one gradation step) over the whole gradation range, however, the addressing operation is required for each subfield. Also, in at least one subfield of each field, a resetting process (address preparation) is required to uniform charged state in the whole screen before addressing. If the resetting process is omitted, the discharge condition varies between the cells remaining with the wall charge (previously turned-on cells) and the other cells (previously turned-off cells), thereby making difficult accurate addressing operation. Normally, the resetting process is performed in each subfield for improving the reliability of the addressing operation.

Since the resetting and the addressing operations are accompanied by the discharge, however, these processes are desirably performed as few times as possible from the viewpoint of contrast and power consumption. Especially for the high-definition PDP in which a large burden is imposed on the circuit parts for the addressing operation, a reduced number of times of addressing is desired if only to suppress the heat generation.

A driving method has been proposed in which a predetermined number of subfields are separated into a plurality of subfield groups in each of which the resetting process is performed once (Japanese Patent No.2639311). The subfields of each subfield group are equalized in weight, and the weight of each subfield is determined by adding a minimum weight to the total of weights smaller than the weight of the particular subfield. In this way, the gradation width can be equalized over the entire gradation range.

In the conventional method, the number of times the sustaining discharge occurs (i.e. the number of times the sustaining voltage is applied) is uniquely set for a given weight of brightness, and therefore the number of times of sustaining discharge is the same in each subfield whose weight is equal to one another's.

In the gradation display described above in which each field is configured of a plurality of subfields, a combination of subfields in which the total weight assumes a value corresponding to the required gradation is selected to be turned on, and the total weight of the selected subfields is proportional to the gradation of the input image.

Although the larger the number of times the sustaining discharge occurs, the higher the actual brightness, the two are not proportional to each other. In other words, the brightness tends to be saturated as the number of times of the sustaining discharge increases. This poses the problem that the reproducibility of the bright side of the gradation range is lower than that of the dark side thereof.

SUMMARY OF THE INVENTION

The object of the present invention is to improve the gradation reproducibility while improving the contrast and reducing power consumption.

According to a preferred aspect of the invention, there is provided a method of driving a PDP in which each field is configured of a plurality of subfields, and subfields of each field are separated into a plurality of subfield groups. Each subfield of a subfield group is weighted in brightness so that the weight is equal for each subfield in the subfield group. An address period and a sustain period are allocated to each subfield for gradation display. In this way, in at least one subfield group having a plurality of subfields, the number of times the sustaining discharge occurs is set different between a subfield to be independently turned on and the remaining one or more subfields. As described above, the gradation is corrected by individually setting the optimum number of times the sustaining discharge occurs for each subfield even if the weight of brightness is same.

In this invention, the word "field" is defined as a unit image for image display in time series. Specifically, each field of a frame for the interlace system of TV constitutes a "field" and a frame of the no-interlace system (which can be regarded as one-to-one interlace) as represented by the computer output is defined also as a "field".

BRIEF DESCRIPTION OF THE DRAWINGS

FIG. 7 is a chart showing the set number of times for the sustaining discharge.

DESCRIPTION OF THE PREFERRED EMBODIMENTS

Figure 1:
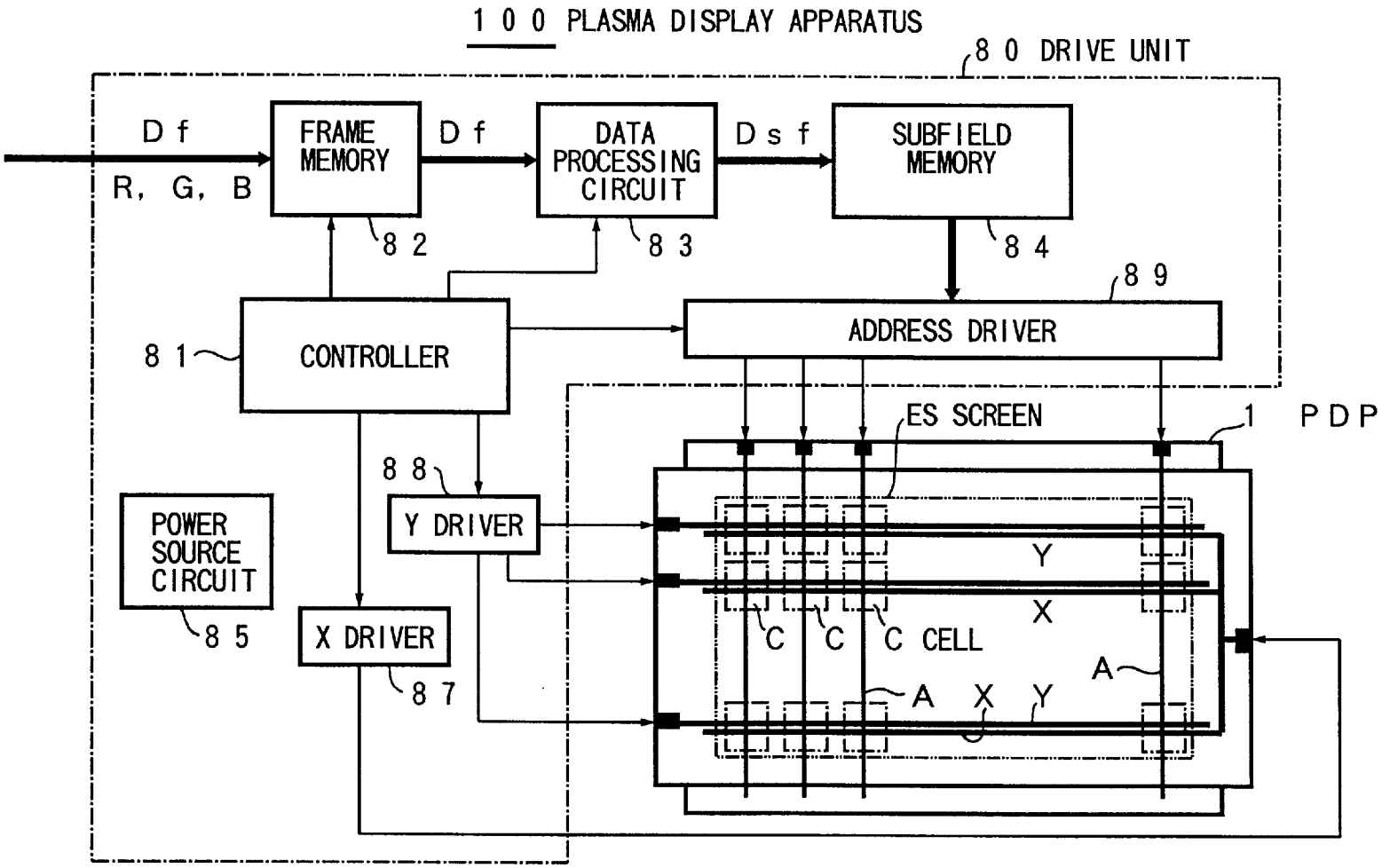
FIG. 1 is a block diagram showing a configuration of a display apparatus according to an embodiment of the invention.

FIG. 1 is a block diagram showing a configuration of a display apparatus according to an embodiment of the invention.

A plasma display apparatus 100 comprises a PDP 1 of AC type constituting a color display device of matrix type, and a drive unit 80 for selectively tuning on a multiplicity of cells C making up a screen ES. This plasma display apparatus 100 is used for a wall-mounted TV set, a monitor for a computer system, etc.

The PDP 1 has a three-electrode surface discharge structure, in which first and second main electrodes X, Y constituting a pair are arranged in parallel, and the main electrodes X, Y cross an address electrode A making up a third electrode in each cell C. The main electrodes X, Y extend along the rows (horizontal direction) in the screen. The main electrode Y is used as a scan electrode for selecting a cell in each row at the time of addressing. The address electrode A extends along the columns (vertical direction) and is used as a data electrode for selecting a cell in each column. The main electrodes and the address electrodes cross each other in a display area, i.e. a screen ES.

The drive unit 80 includes a controller 81, a frame memory 82, a data processing circuit 83, a subfield memory 84, a power source circuit 85, an X driver 87, a Y driver 88 and an address driver 89. The drive unit 80 is supplied with a field data Df of each pixel indicating the brightness level (gradation) of each of the R, G and B colors from an external unit such as a TV tuner or computer, together with various synchronizing signals.

The field data Df, after being stored temporarily in the frame memory 82, is sent to the data processing circuit 83. The data processing circuit 83 is data conversion means for setting a combination of subfields to be turned on, and outputs the subfield data Dsf corresponding to the field data Df. The subfield data Dsf is stored in the subfield memory 84. The value of each bit of the subfield data Dsf is information indicating whether or not the turning on of the cells in the subfield is required, or strictly speaking, whether the address discharge is required or not.

The X driver 87 applies a drive voltage to the main electrode X, and the Y driver 88 applies a drive voltage to the main electrode Y. The address driver 89 applies a drive voltage to the address electrode A in accordance with the subfield data Dsf. These drivers are supplied with predetermined power from the power source circuit 85.

Figure 2:
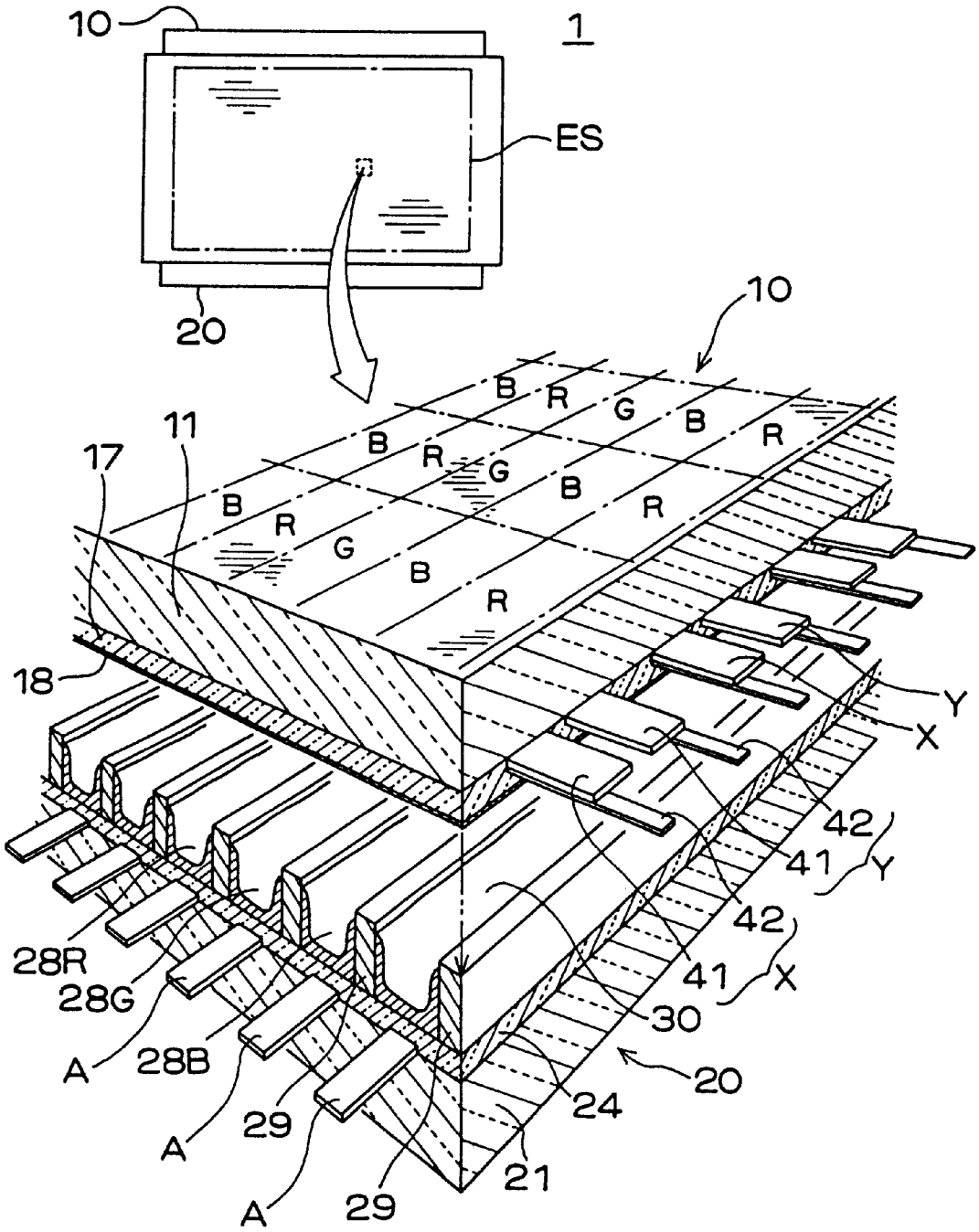
FIG. 2 is an exploded perspective view showing an internal structure of the PDP according to an embodiment of the invention.

FIG. 2 is an exploded perspective view showing the internal structure of a PDP according to an embodiment of the invention.

The PDP 1 includes a pair of main electrodes X, Y for each row of the matrix screen on the inner surface of a glass substrate 11 constituting the base of a substrate structure 10 on the front side. The row is a horizontal cell row. The main electrodes X, Y are each made of a transparent conductive film 41 and a metal film (bus conductor) 42, and are covered with a dielectric layer 17 about 30 microns thick. The surface of the dielectric layer 17 is formed with a protective film 18 of magnesia (MgO) having a thickness of several thousand angstroms. Each address electrode A is arranged on a base layer 22 covering the inner surface of the glass substrate 21 on the back side and is covered with a dielectric layer 24 about 10 microns thick. Partitioning walls 29 in the form of linear stripes having approximately 150 microns high in plan view are formed, one each between every adjacent address electrodes A, on the dielectric layer 24. These partitioning walls 29 segment the discharge space 30 into subpixels (unit luminous areas) along the rows and at the same time define the interval of the discharge space 30. Phosphor layers 28R, 28G, 28B for color display of three colors R, G, B, respectively, are formed in such a position as to cover the wall surface of the back side including the sides of the partitioning walls 29 above the address electrodes A. Each display pixel (picture element) is configured of three subpixels aligned along the rows, and the luminous color of the subpixels in each column is the same. The internal structure of each subpixel constitutes a cell (display element) C. The partitioning walls 29 are arranged in a pattern of stripes, and therefore the portion of the discharge space 30 corresponding to each column is formed continuously along the column over all the rows.

Now, an explanation will be given of a method of driving the PDP 1 for the plasma display apparatus 100.

Figure 3:
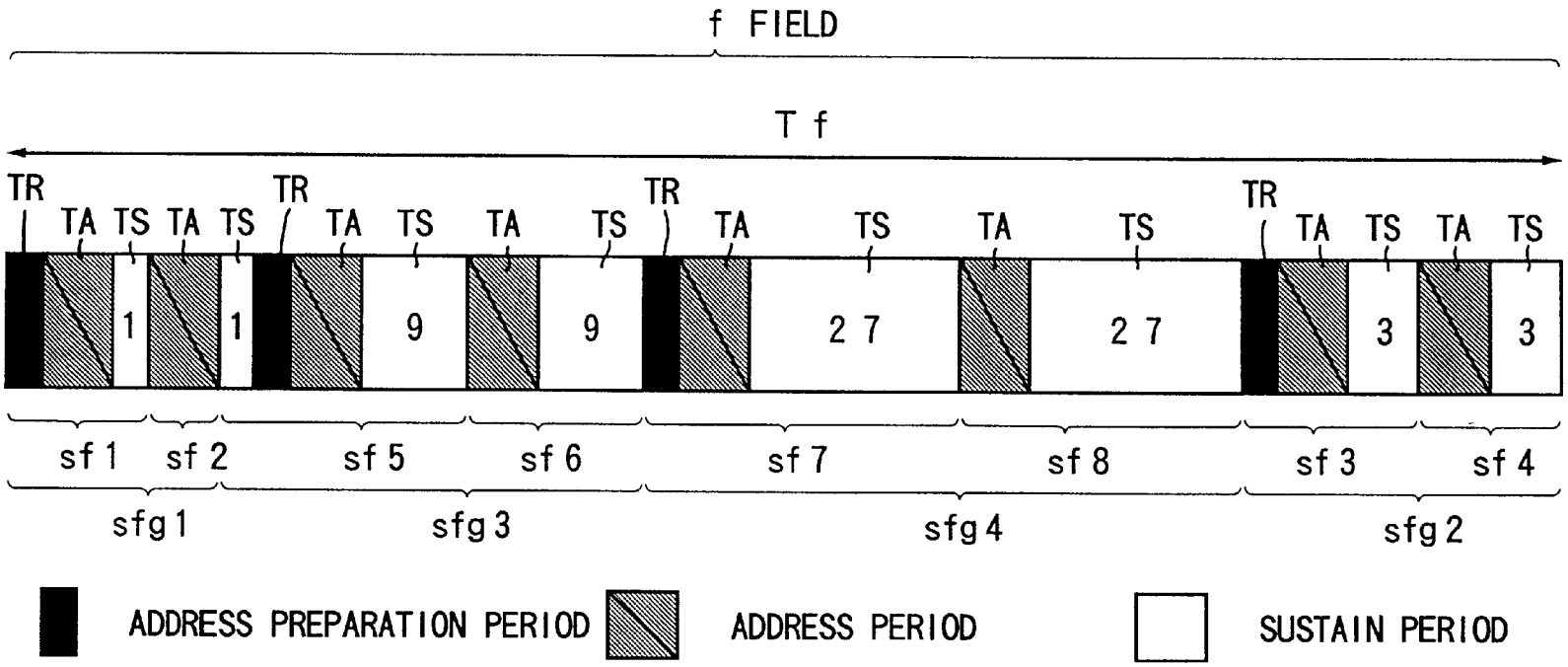
FIG. 3 is a diagram showing an example of a field configuration.

An example of a field configuration is shown in FIG. 3.

For reproducing the gradation by binary on-off control, the fields f in time series constituting an input image are divided into eight subfields sf1, sf2, sf3, sf4, sf5, sf6, sf7, sf8, for example. In other words, the field f is displayed in a replacement set of eight subfields sf1 to sf8. Each of the subfields sf1 to sf8 is allocated with an address period TA for controlling the wall charge of each cell and a sustain period TS for maintaining the on-state using the wall charge. In order to reduce the number of times of addressing, the subfields sf1 to sf8 are separated into a plurality of subfield groups sfg1, sfg2, sfg3, sfg4, each of which is allocated with an address preparation period TR. In the shown case, there are four subfield groups and each subfield group has two subfields, so that two subfields are uniformly included in each subfield group. However, the number of subfield groups may be other than four, and the number of subfields included in each subfield group is not necessarily uniform.

According to this embodiment, the brightness weight of the subfields sf1, sf2 of the first subfield group sfg1 is a minimum "1", and the brightness weight of the subfields sf3, sf4 of the second subfield group sfg2 is "3". Also, the brightness weight of the subfields sf5, sf6 included in the third subfield group sfg3 is "9", and the brightness weight of the subfields sf7, sf8 of the fourth subfield group sfg4 is "27". In the second, third and fourth subfield groups sfg2, sfg3, sfg4, the weight of each subfield is an integer multiple of the minimum weight "1" and is the sum of the total of smaller weights and unity. Specifically, $3=1\times2+1$, $9=1\times2+3\times2+1$, $27=1\times2+3\times2+9\times2+1$. With the above-mentioned field configuration of weights 1, 1, 3, 3, 9, 9, 27, 27, the 81 gradation levels 0 to 80 can be displayed by the on-off combination of the subfields. The address preparation period TR and the address period TA are constant, while the sustain period TS is longer, the larger the brightness weight.

The subfield groups sfg1 to sfg4 are displayed in the order of sfg1, sfg3, sfg4 and sfg2. According to this order, the subfield group sfg4 having the largest total weight is displayed in the middle of the field period Tf. Therefore, the display quality is improved as the light emission is generated more times over the period including the preceding and following fields.

Figure 4:
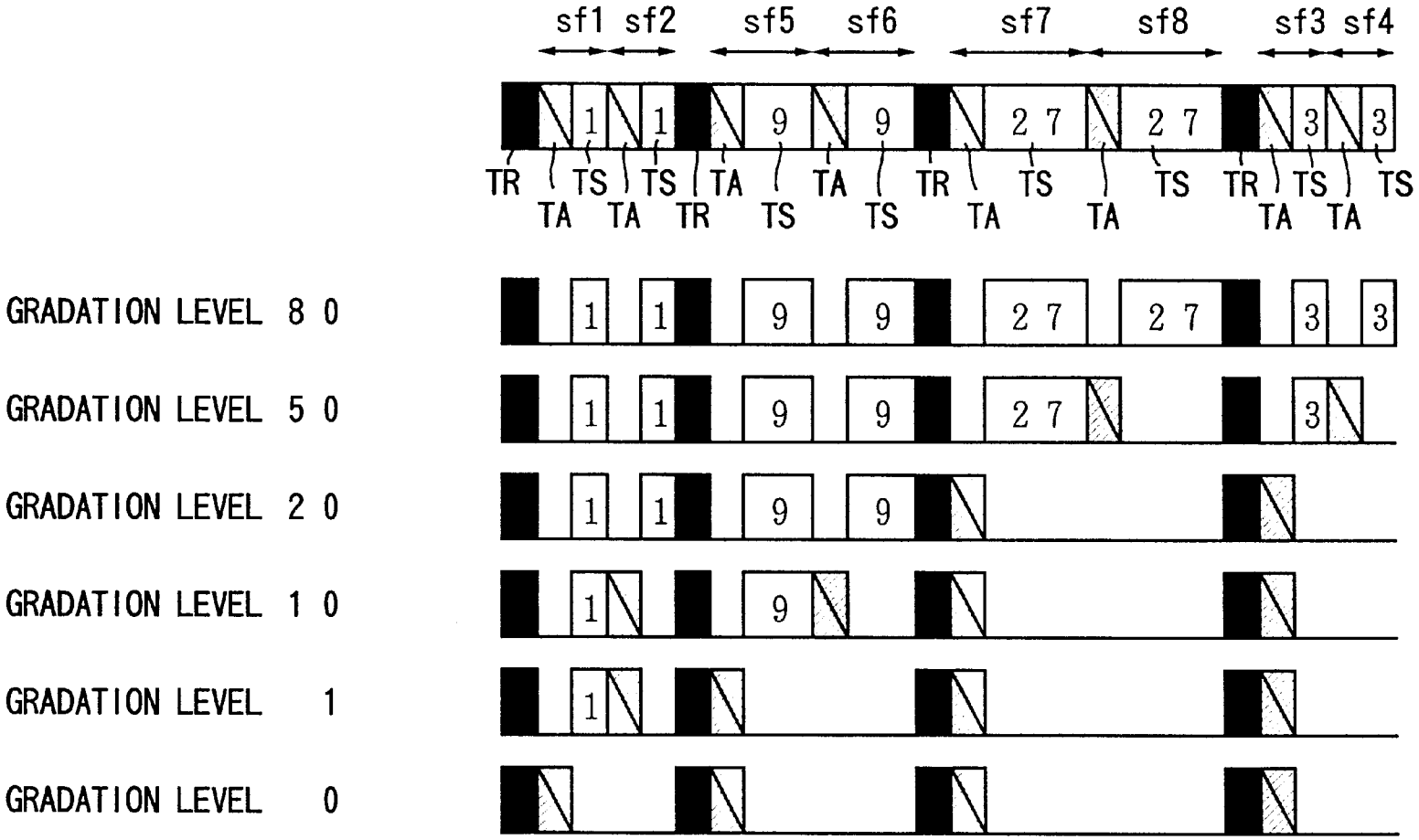
FIG. 4 is a diagram schematically showing the driving sequence of erase address type.

FIG. 4 is a diagram schematically showing the drive sequence of erase address type.

As described above, the combination of the subfields for tuning on the cells is determined according to the gradation level indicated by the field data Df In the drive sequence of erase address type, the wall charge of an amount suitable for sustaining the on state is formed in all the cells in the screen during the address preparation period TR, and the wall charge of the cells not required to turn on are erased during a subsequent predetermined address period TA.

In the case of erase address type, the subfields for which the on state is sustained independently among the subfields included in each of the subfield groups sfg1 to sfg4 are limited to the front side of the time series (order of display). The cells only in the rear-side subfields cannot be turned on. Assuming, for example, that the gradation level of a cell intended to be reproduced is "1", the subfield sf1 of the subfield group sfg1 is designated to sustain. Specifically, during the address period TA of the front-side subfield sf1, the wall charge for the intended cell is not erased, and the wall charge formed during the address preparation period TR is left intact. As a result, the discharge for sustaining the on state occurs a predetermined number of times during the sustain period TS of the front-side subfield sf1. And the wall charge is erased during the address period TA of the rear-side subfield sf2.

In the case of erase address type, assume that the subfields on both sides of each subfield group are turned on. In such a case, the wall charge is not erased in any address period TA for the particular subfield group.

As described above, the wall charge erase timing is changed in accordance with the gradation to be reproduced for each of the subfield groups sfg1 to sfg4. As compared with the case in which the subfields are not separated into subfield groups, therefore, the number of times of the address preparation can be reduced to the number of subfield groups and the number of times of addressing can be reduced to not more than the number of subfield groups. No addressing operation is required when the gradation level to be reproduced is "80".

In the case where three or more subfields belong to a subfield group, the subfields to be sustained are selected from the leading one sequentially according to the number of subfields involved. Specifically, in each of the subfield groups sfg1 to sfg4, the wall charge of the cells of the gradation level for turning on m of n (2 in the shown case) subfields ($1 \leqq m \leqq n$) is erased during the (m+1)th address period TA.

Figure 5:
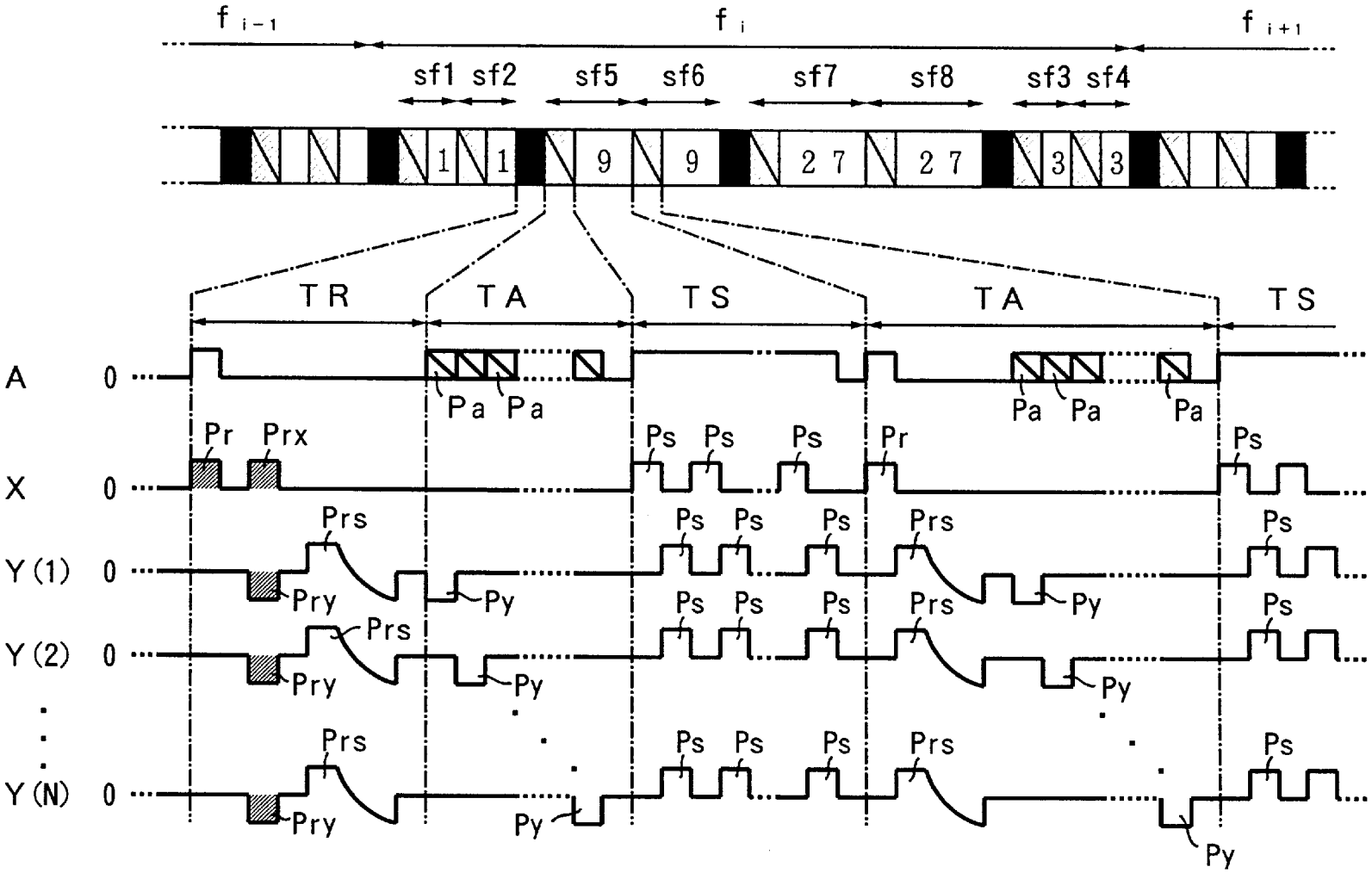
FIG. 5 shows voltage waveforms in an example of the driving sequence.

FIG. 5 shows voltage waveforms according to an example of the drive sequence.

During the address preparation period TR, the wall charge of a predetermined polarity is formed on the previously turned-on cells and the previously turned-off cells through the first step of applying a positive voltage pulse Pr to the main electrode X and the second step of applying a positive voltage Prx to the main electrode X and a negative voltage pulse Pry to the main electrode Y. In the first step, the address electrode A is biased to positive potential, thus preventing the unnecessary discharge between the address electrode A and the main electrode X. Following the second step, in order to improve the uniformity of charge, the main electrode Y is supplied with a positive voltage pulse Prs thereby to cause the surface discharge of all the cells. The surface discharge inverts the charged polarities. After that, in order to avoid charge loss, the potential of the main electrode Y is gradually reduced.

In the address period TA following the address preparation period TR, in order to select each line from the leading one sequentially, a negative scan pulse Py is applied to the main electrode Y to be selected. At the same time as line selection, the address electrode A corresponding to the cell to be turned off (turning-off cell) is supplied with a positive address pulse Pa. The cell supplied with the address pulse Pa in the selected line loses the wall charge of the dielectric layer 17 due to the counter discharge between the main electrode Y and the address electrode A. At the time of application of the address pulse Pa, the positive wall charge exists in the neighborhood of the main electrode X. The address pulse Pa is offset by that wall voltage. Therefore, no discharge occurs between the main electrode X and the address electrode A. This address operation of erase type eliminates the need of renewed forming of the charge unlike the write type and therefore is suitable for high-speed operation.

During the sustain period TS, in order to prevent the unnecessary discharge, all the address electrodes A are biased to positive potential and a positive sustain pulse Ps is applied to all the main electrodes X first of all. After that, the main electrodes Y and the main electrodes X are supplied with the sustain pulse Ps alternately. The application of the sustain pulse Ps causes the surface discharge in the cells still having the wall charge (turning-on cells) during the address period TA. Normally, in setting the number of times the sustain pulse Ps is applied, a sustain pulse Ps applied to the main electrode X is paired with the following sustain pulse Ps applied to the main electrode Y. In the example shown in FIG. 5, therefore, it follows that the last sustain pulse Ps is applied to the main electrode Y in all the subfields sf1 to sf8.

During the address period TA following the sustain period TS, for the purpose of regulating the charge distribution, a voltage pulse Pr is applied to the main electrode X while at the same time applying a voltage pulse Prs to the main electrode Y. Like in the address preparation period TR, the potential of the main electrode Y is gradually reduced, after which the line-by-line address operation is performed the same way as during the first address period TA.

Figure 6:
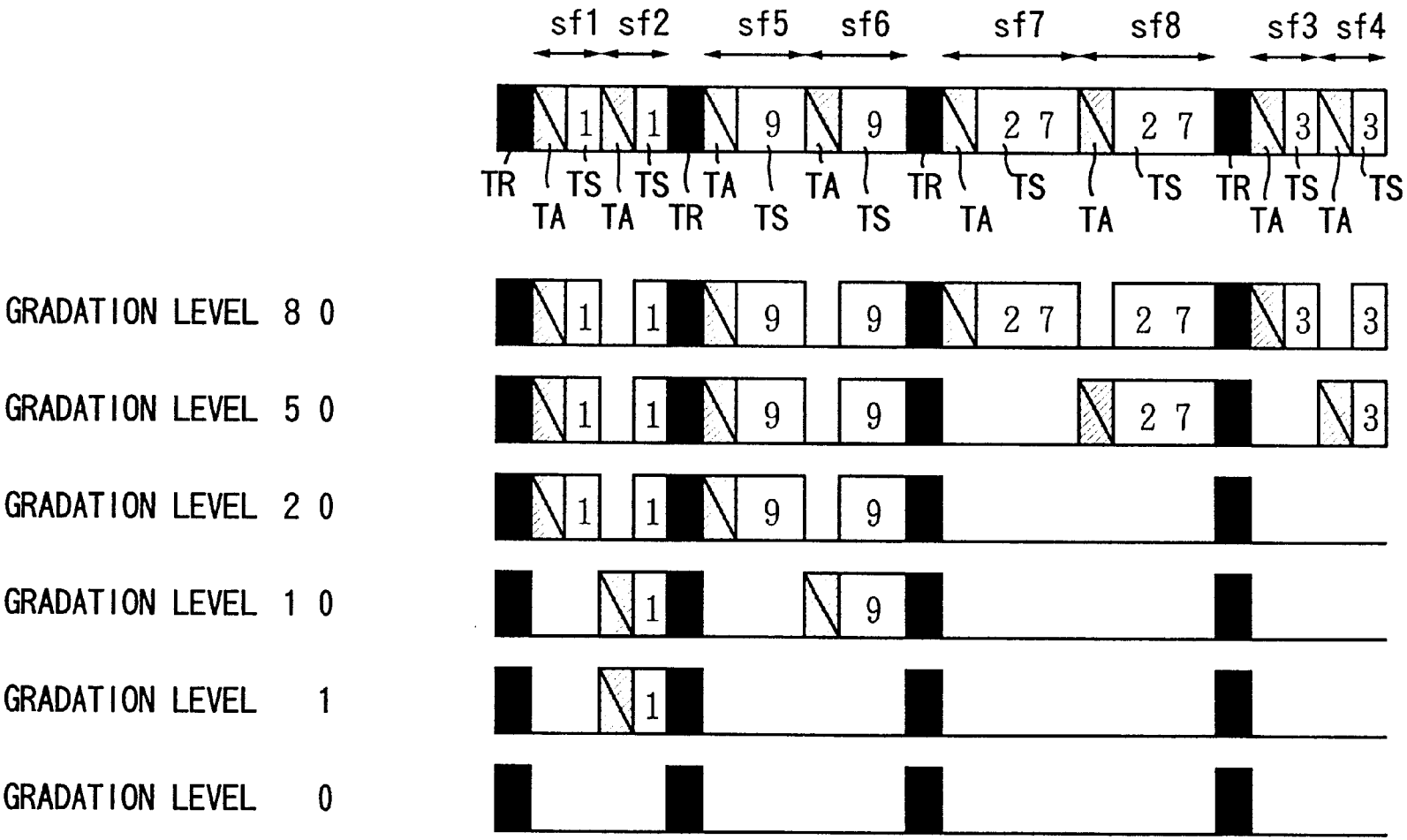
FIG. 6 is a diagram schematically showing the driving sequence of write address type.

FIG. 6 is a diagram schematically showing the driving sequence of write address type.

In write address type, the wall charge of all the cells in the screen is erased during the address preparation period TR, and the wall charge of the cells to be turned on is formed during a predetermined subsequent address period TA.

With the write address type, the subfields to be turned on independently among those included the subfield groups sfg1 to sfg4 are limited to those existing on the rear side of the time series. The cells cannot be turned on only with the front-side subfields. In the case where the gradation level of the intended cells to be reproduced is "1", for example, the subfield sf2 of the subfield group sfg1 is sustained. Specifically, the wall charge is not formed (written) for the intended cell during the address period TA of the front-side subfield sf1, but the intended cell is written in during the address period TA of the rear-side subfield sf2. During the sustain period TS of both the subfields sf1, sf2, the sustain voltage is applied, but the intended cell is not turned on during the sustain period TS of the subfield sf1 which has not been written.

FIG. 7 is a chart showing the set number of times for the sustaining discharge.

As described above, the brightness is weighted in such a manner as to reproduce each of 80 gradation levels of equal width for each of the subfields sf1 to sf8. Therefore, the subfields of each of the subfield groups sfg1 to sfg4 have equal brightness weight.

On the other hand, according to the principle of the invention, the number of times of sustaining discharge occurs expressed by the number of sustaining pulse pairs is set for each subfield in such a manner as to produce the brightness corresponding to the total sum of the weight of the subfields to be sustained. Therefore, the set number is varied from one subfield to another having the same brightness weight. Specifically, assume that Q is the number of times the sustaining discharge occurs set for one of two subfields intended to be sustained independently in each of the subfield groups sfg1 to sfg4. The number of times the sustaining discharge occurs set for the other subfield is given as Q+q, where q is an integer satisfying the relation $1 \leqq q \leqq Q$ which is the brightness correction amount optimized for each of the subfield groups sfg1 to sfg4. The subfield intended to sustain independently is the leading (front side in the shown case) one for erase address type, or the last (rear side in the shown case) subfield in the case of write address type.

In the case where each of the subfield groups sfg1 to sfg4 has at least three subfields, the brightness correction amount q for two or more subfields can be equalized, or a different brightness correction amount can be set from one subfield to another according to the number k of subfields intended to sustain, in such a manner as q, 2×q, 3×q . . . k×q.

As described above, according to the embodiments, the contrast can be improved and the power consumption can be reduced, while at the same time improving the gradation reproducibility.

What is claimed is:

1. A method of driving a plasma display panel to display gradation, comprising:

constituting a field with a plurality of subfields;

separating the subfields of each field into a plurality of subfield groups;

weighting each subfield in brightness equally in the subfield group to which the subfield belongs; and allocating an address period and a sustain period to each subfield, wherein in at least one subfield group having a plurality of subfields, a set number of times of sustaining discharge for a subfield to be sustained independently is different from a set number of times of sustaining discharge for at least one other subfield.

2. The method according to claim 1, wherein the weight of brightness of each subfield constituting a field is the total of weights smaller than the weight of brightness plus a minimum weight.

3. The method according to claim 2, further comprising allocating an address preparation period to at least one subfield in each subfield group, and erasing charges of all the cells in the screen during the address preparation period.

4. A method of driving a plasma display panel to display gradation, comprising:

constituting a field with a plurality of subfields;

separating the subfields of each field into a plurality of subfield groups;

weighing each subfield in brightness equally in the subfield group to which the subfield belongs;

allocating an address period and a sustain period to each subfield;

allocating an address preparation period to each subfield group;

forming a charge for sustaining a discharge in each of the cells of the screen during the address preparation period; and erasing the charge during the address period of a specific subfield according to the gradation to be reproduced, wherein in at least one subfield group having a plurality of subfields, a set number of times of sustaining discharge for the leading subfield in a time series is less than a set number of times of sustaining discharge for at least one other subfield.

5. The method according to claim 4, wherein the weight of brightness of each subfield constituting a field is the total of weight smaller than the weight of brightness plus a minimum weight.

6. A method of driving a plasma display panel to display gradation, comprising:

constituting a field with a plurality of subfields;

separating the subfields of each field into a plurality of subfield groups;

weighting each subfield in brightness equally in the subfield group to which the subfield belongs;

allocating an address period and a sustain period to each subfield;

allocating an address preparation period to each subfield group;

erasing charge of the whole screen during the address preparation period; and forming a charge for sustaining discharge during the address period of a specific subfield according to the gradation to be reproduced, wherein in at least one subfield group having a plurality of subfields, a set number of times of sustaining discharge for a last subfield in time series is less than a set number of times of sustaining discharge for at least one other subfield.

7. The method according to claim 6, wherein the weight of brightness of each subfield constituting a field is the total of weight smaller than the weight of brightness plus a minimum weight.

8. A plasma display apparatus, comprising:

a plasma display panel of a three-electrode surface discharge structure including a plurality of main electrodes arranged to configure an electrode pair for generating a surface discharge for each row of a matrix display and a plurality of electrodes arranged for addressing each column of the matrix display, wherein each field includes a plurality of subfields, the subfields of each field are separated into a plurality of subfield groups, each subfield is weighted in brightness equally in the subfield group to which the subfield belongs, and the address period and the sustain period are allocated to each subfield for displaying the gradation, and wherein in at least one subfield group having a plurality of subfields, a set number of times of sustaining discharge for a subfield to be sustained independently is different from a set number of times of sustaining discharge for at least one other subfield.

9. A plasma display apparatus, comprising:

a plasma display panel of a three-electrode surface discharge structure including a plurality of main electrodes arranged to configure an electrode pair for generating a surface discharge for each row of a matrix display and a plurality of electrodes arranged for addressing each column of the matrix display, wherein each field includes a plurality of subfields, the subfields of each field are separated into a plurality of subfield groups, each subfield is weighted in brightness equally in the subfield group to which the subfield belongs, the address period and the sustain period are allocated to each subfield, an address preparation period is allocated to each subfield group, a sustaining charge is formed for all the cells in the screen during the address preparation period, and the charge is erased during the address period of a specific subfield according to the gradation to be reproduced, thereby displaying the gradation, and wherein in at least one subfield group having a plurality of subfields, a set number of times of sustaining discharge for a leading subfield in a time series is less than a set number of times of sustaining discharge for at least one other subfield.

* * * * *

UNITED STATES PATENT AND TRADEMARK OFFICE

CERTIFICATE OF CORRECTION

PATENT NO. : 6,278,422 B1
DATED : August 21, 2001
INVENTOR(S) : Yoshitaka Ukai et al.

It is certified that error appears in the above-identified patent and that said Letters Patent is hereby corrected as shown below:

Column 8,
Line 26, change "weight" to -- weights --.
Line 52, change "weight" to -- weights --.

Signed and Sealed this

Twenty-sixth Day of February, 2002

*Attest:*

*Attesting Officer*

JAMES E. ROGAN
*Director of the United States Patent and Trademark Office*